United States Patent [19]

Nakano et al.

[11] 4,029,826

[45] June 14, 1977

[54] ELECTROSTATIC PRINTING METHOD

[75] Inventors: Keita Nakano; Kiyoshi Horie; Noriaki Yamazaki, all of Ebina, Japan

[73] Assignee: Fuji Xerox Co., Ltd., Tokyo, Japan

[22] Filed: Oct. 2, 1974

[21] Appl. No.: 511,278

[30] Foreign Application Priority Data

Oct. 9, 1973 Japan ..... 48-112875

[52] U.S. Cl. ..... 427/16; 96/1 LY; 427/17; 427/24

[51] Int. Cl.[2] ..... G03G 13/10

[58] Field of Search ..... 427/16, 15, 17, 24; 96/1 LY

[56] References Cited

UNITED STATES PATENTS

| | | | |
|---|---|---|---|
| 2,991,754 | 7/1961 | Johnson | 118/637 |
| 3,038,073 | 6/1962 | Johnson | 250/49.5 |
| 3,084,043 | 4/1963 | Gundlach | 96/1 LY |
| 3,276,896 | 10/1966 | Fisher | 96/1 LY |
| 3,627,557 | 12/1971 | Sato et al. | 118/DIG. 23 |
| 3,642,471 | 3/1972 | Sato et al. | 96/1 LY |
| 3,667,428 | 6/1972 | Smith | 118/DIG. 23 |
| 3,671,290 | 6/1972 | Matsumoto et al. | 427/16 |
| 3,748,126 | 7/1973 | Ferguson et al. | 96/1 LY |
| 3,804,658 | 4/1974 | Metcalfe et al. | 427/17 X |
| 3,806,354 | 4/1974 | Amidon et al. | 96/1.4 |
| 3,817,748 | 6/1974 | Whittaker | 96/1 R |
| 3,830,199 | 8/1974 | Saito et al. | 118/637 |
| 3,851,964 | 12/1974 | Smith et al. | 96/1.4 |

*Primary Examiner*—Ronald H. Smith
*Assistant Examiner*—Stuart D. Frenkel
*Attorney, Agent, or Firm*—Gerald J. Ferguson, Jr.; Joseph J. Baker

[57] ABSTRACT

An electrostatic printing method for developing an electrostatic latent image on a recording member by first developing the image by the "electrostatic developing" method in which a liquid developer comprising an insulating liquid vehicle and a solid colorant is electrostatically attracted and applied only to the electrostatic latent image, and then further developing the image, by "liquid developing" in which an insulating liquid miscible with the vehicle used in the electrostatic developing step and containing substantially no coloring matter is applied to the image and non-image areas on the recording member, whereby some of the solid colorant attracted to the electrostatic image is charged and migrates to any image portion not developed by the electrostatic developing step.

3 Claims, 6 Drawing Figures

ELECTROSTATIC PRINTING METHOD

BACKGROUND OF THE INVENTION

1. Field of the Invention

This invention relates to an electrostatic printing method utilizing electrostatic copying methods where liquid ink is applied from a developing surface having substantially uniform projections thereon to develop an electrostatic latent image, the spaces between the projections being filled with the ink.

2. Discussion of the Prior Art

The term electrostatic copying method as used throughout this specification is directed to such processes as (1) an electrophotographic copying method where a photoconductive surface is charged with electricity, and exposed to a light image, to thereby form an electrostatic latent image thereon; (2) an electrostatic recording method where a dielectric surface is scanned with a needle electrode to form an electrostatic latent image thereon; or (3) a copying method where a photoconductive member is impressed with bias voltage and then exposed to a light-image to form an electrostatic latent image thereon. In these electrostatic copying methods, developing methods are known such as the cascade developing method and the liquid developing method, which is characterized by electrophoresis. The liquid developing method is advantageous in that the dimensions of the developing unit are reduced and image resolution is high. The liquid developing method, however, has drawbacks in that a latent image bearing photoconductive sheet must be immersed in its entirety into the liquid developer and thus the background area tends to be stained.

To reduce the possibility of background area stain to a minimum, the amount of toner contained in the carrier insulating liquid of the developer must be controlled, its permissible range being within 0.5% at the most. Accordingly, when a developed picture image of high density is desired, the liquid developing method is not available.

In order to overcome the above-described drawbacks, an electrostatic attraction developing method, as disclosed in the specifications of U.S. Pat. No. 3,084,043 and Japanese Patent Publication No. 44-9,512(1970), has been utilized where a liquid ink is applied to a latent image bearing member having an electrostatic charge pattern or a conductive pattern to effect a wet development. An important feature of this developing method is that the developer ink is applied from a geometrically uneven developing surface. More concretely, the liquid ink applying member may comprise an iron pipe having fine spiral grooves whose pitch may be as small as about 0.1mm. When developing, liquid ink fills the grooves with excess ink being removed therefrom by a scraper means such as a doctor blade. The ink applying member is brought into contact with an electrostatic latent image bearing photoconductive material so that the liquid ink adjacent the electrostatic latent image is attracted by an electrostatic attracting force whereby the ink is attracted to the crest portions of the afore-said grooves to moisten the photoconductive material and thereby effect the desired development.

In the afore-said electrostatic attraction developing method, a roll-shaped developer applying member is typically used and unlike the first-mentioned liquid developing method, the photoconductive sheet need not be dipped in the developing liquid. Accordingly, only a small amount of developing liquid is used. This advantageously permits further miniaturization of the developing unit, as compared with that of the first-mentioned liquid developing method. In the developing method where ink is attracted to an area corresponding only to the latent image formed on the photoconductive material, there is less limitation on the toner density. Thus, a toner of high density may be used unlike the first-mentioned liquid developing method.

Thus, the aforesaid electrostatic attraction developing method is superior in many aspects to the liquid developing method. The former method, however, still presents the following difficulties. Assume an electrostatic latent image exists adjacent the grooves of an ink applying member *b*, as shown in FIG. 1. The bank areas and their immediate vicinities alone are moistened with liquid ink as shown by reference numeral *c* in FIG. 2, with an inter-area between bank areas remaining unmoistened, as shown in FIG. 3. Although this phenomenon hardly occurs where the charge density of the electrostatic latent image is high, it is very often experienced in areas where electric charge density, such as accompanies an image of neutral tone, is low. For this reason, those portions of the latent image adjacent a trough portion of the grooves provided on ink applying member *b*, may not be developed as shown at *d*. This lowers the density of developed image, causes discontinuation in lines, and skips in a picture image, all of which degradate image quality.

SUMMARY OF THE INVENTION

An object of the present invention is the provision of an electrostatic printing method, which is free of the drawbacks of the aforesaid liquid developing method and the aforesaid electrostatic attraction developing method.

DETAILED DESCRIPTION OF PREFERRED EMBODIMENT

Figure 5:
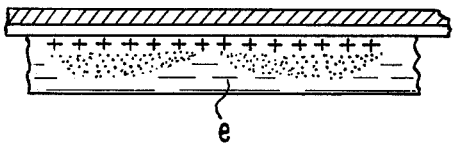
Figure 6:
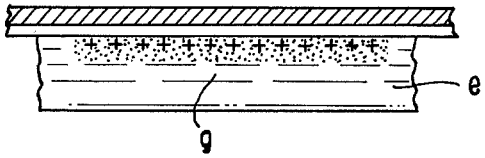

Referring to FIGS. 1–4, an electrostatic latent image formed on a photoconductive material *a* is first developed by the aforesaid electrostatic attraction development method, after which the picture image thus developed is further developed by applying thereto, preferably in a dark place, and insulating liquid *e* using an applicator member *f* such as a rubber roller. Pigments within the ink affixed to the picture image corresponding to the crest or bank portions of the picture image are thus charged with a given polarity in the insulating liquid *e*, to thereby cause electrophoresis, as a result of which the pigments migrate to any undeveloped portions of the image, as indicated in FIG. 5 and then adhere to the undeveloped portions as shown in FIG. 6 thereby achieving the uniform developing.

Thus, the electrostatic attraction developing method is, in effect, combined with the liquid developing method so that miniaturization of the developing unit occurs and picture images of high density may be obtained. The latter are features of the electrostatic attraction developing method. In addition, the picture image has high resolution, a feature of the liquid developing method. Furthermore, in the method of the present invention, electrophoresis, in the insulating liquid, of ink pigments affixed to a portion of the picture image, is effected only in the vicinity of the developed portion such that there is no risk of staining the background area or impairing high density picture images even though the liquid developing method is used. Discontinuation or skips in the picture image are eliminated so that a high density thereof is present in its entirety.

Figure 1:
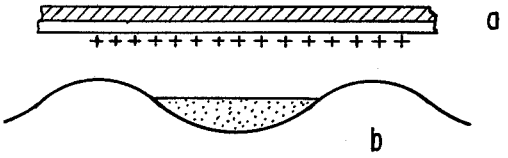
FIG. 1 (PRIOR ART)
FIGS. 1 through 3 are diagrammatic representations, which illustrate a drawback of the prior art electrostatic attraction developing method.
Figure 2:
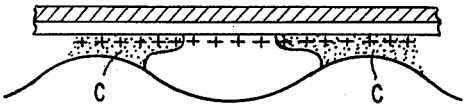
FIG. 2 (PRIOR ART)
Figure 3:
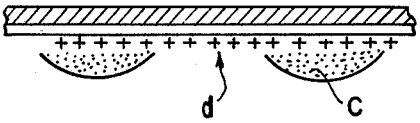
FIG. 3 (PRIOR ART)
Figure 4:
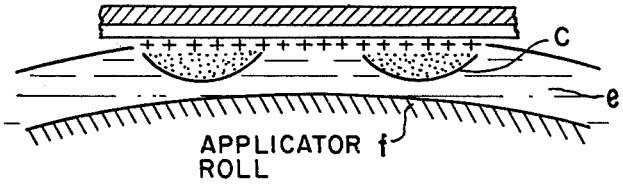
FIGS. 4 through 6 are diagrammatic representations which illustrate a typical embodiment of the electrostatic printing method of the present invention, in which the liquid developing method is combined with the electrostatic attraction developing method.

The foregoing is thought to result from the fact that the ink of FIG. 4, which is dissolved in the insulating liquid, is limited to only the surface area of material *a* and hence no effect is given to the initial density of the image.

The particles of ink pigments are charged to a given polarity in the insulating liquid, which polarity varies depending on the kind of pigment used in the ink and the kind of insulating liquid. Accordingly, appropriate selection of pigment or insulating liquid is required for obtaining a desired polarity. Such selection is well known in the liquid development art.

In the present invention, the vehicle of the liquid ink used in the electrostatic attraction developing step and the insulating liquid used in the liquid developing step both have a volume electric resistivity in the range of $10^5 - 10^{15}\Omega$. cm, and a viscosity in the range of 100 – 10,000 cps.

The liquid ink used in the electrostatic attraction developing step is composed of a vehicle, a pigment, a surface-active agent, and resin where the combination of pigment, resin, and so forth can be selected in a fairly wide range by properly selecting the volume resistivity of the vehicle.

Vehicles recommended for use include liquid paraffin, castor oil, polypropylene glycol, propylene glycol, silicon oil, or butyl cellosolve when using an oil base, and water or the like, when using a water base ink.

With regard to the pigment, it simply should have good miscibility with the vehicle. A pigment of any type generally proves to be usable, as a rule, if the pigment can be used as a printing ink. Examples of this classification of pigments include indanthrene blue, phthalocyanin blue, indanthrene violet, toluidine yellow, naphthol yellow, azo-red, lithsol red, phthaiocyannine green, and so forth, as organic pigments, and ultramarine, Prussian blue, yellow iron oxide, molybdenum blue, Indian red, cadmium red, antimony red, chrome green, carbon black, and so forth, as inorganic pigments.

The insulating liquid used in the liquid developing step can be any of those used as the insulating carrier liquid typically used in the well known liquid developing process where the liquid developer typically includes a toner and an insulating carrier liquid therefor.

As is apparent from the foregoing, the electrostatic printing method of the present invention combines the liquid developing method and electrostatic attraction developing method to thereby provide an ingenious method utilizing the advantages of both methods.

The description hereinafter given relates to examples of the present invention.

EXAMPLE 1

An ink applying member comprising a developing roller made of an iron pipe having a diameter of 40mm was provided with spiral grooves each making an angle of 45° with respect to the axis thereof and having a pitch 0.14mm and a depth of 30$\mu$. Ink of the following composition was then charged to the grooves. Excess ink was scraped off using a wiper blade of urethan rubber having a hardness of 70°.

| Composition of ink | |
|---|---|
| Light liquid paraffin | 45.1% |
| Microlith CT Black (Predispersed carbon black, a product of Swiss Ciba Company) | 27.1% |
| Ganex V 216 (Alkylated polyvinylpyrolidon, a product of General Aniline Co.) | 22.6% |
| Solid paraffin | 4.5% |
| Methyl violet tannate | 0.7% |
| | 100% |

Subsequently, charging and image exposure of a selenium were effected according to the conventional electrophotographic method to form an electrostatic latent image thereon. The developing roller moistened with ink was then brought into contact with the drum and rotated along the drum surface, whereby an image-like pattern was developed on the drum.

Liquid paraffin (having a viscosity of 1.75 cps) was then applied to a roller spaced 1mm from the selenium drum, the amount of liquid paraffin being sufficient to contact the drum. The picture image on the selenium drum was fully moistened with liquid parafin, followed by, after 1 second, the transfer of the picture image onto conventional transfer paper, thereby producing a picture image free from line discontinuations and of a high image resolution. The resolution, if the electrostatic attraction method alone was used, was 7 line/mm, and it was increased to 10 lines/mm by the method of the present invention.

EXAMPLE 2

Ink having the following composition was applied to the developing roller used in Example 1. The developing roller was used as in Example 1 to develop a latent image on the selenium drum of Example 1. An isoparaffin base hydrocarbon, "Shellsol 71" (having a viscosity of 0.3 cps), a product of Shell Company, was then applied to the picture image thus developed with the roller of Example 1, until the image on the selenium drum was fully moistened. Next, after about 1 second, the afore-said picture image was transferred onto conventional transfer paper, thereby producing a picture image having an excellent resolution of 15 lines/mm.

| Composition of ink: | |
|---|---|
| propylene glycol | 60% |
| Microlith CT black (Predispersed carbon black, a product of Swiss Ciba Company) | 25% |
| Triethylene glycol dicaprylate | 15% |
| | 100% |

What is claimed is:

1. An electrostatic printing method comprising the steps of forming an electrostatic latent image on a recording member;

first developing said electrostatic latent image with a liquid ink comprising an insulating liquid vehicle and at least one solid coloring material, said liquid ink being applied from a developing surface having substantially uniform projections thereon, the spaces between said projections being so filled with said ink that the ink is normally maintained out of contact with the surface of said recording member whereby said liquid ink is electrostatically attracted and applied only to said electrostatic latent image and not to the non-charged background area of said image so that said ink adheres to at least part of said latent image; and subsequent to said first developing step and prior to the evaporation of said ink, further developing said image by applying to both the developed electrostatic latent image and said non-charged background area an insulating liquid miscible with said insulating liquid vehicle and containing substantially no coloring matter to charge some of the solid coloring material in said ink which adhered to said part of said latent image to a given polarity in said insulating liquid to thereby cause electrophoresis of the charged solid coloring material in the insulating liquid, as a result of which said charged solid coloring material adheres to portions of said latent image left undeveloped by the first developing step to thereby complete the development of said last-mentioned portions.

2. A method as in claim 1 where liquid ink is applied from a roller where said uniform projections correspond to spiral grooves disposed about said roller.

3. A method as in claim 1 including providing a transfer member to which the developed image can be transferred, said further developing step occurring prior to the transfer of the developed image to the transfer member.

* * * * *